US006457261B1

(12) United States Patent
Crary

(10) Patent No.: US 6,457,261 B1
(45) Date of Patent: Oct. 1, 2002

(54) SHOCK ABSORBING MIDSOLE FOR AN ATHLETIC SHOE

(75) Inventor: Nathan Crary, Los Alamitos, CA (US)

(73) Assignee: LL International Shoe Company, Inc., Los Angeles, CA (US)

( * ) Notice: Subject to any disclaimer, the term of this patent is extended or adjusted under 35 U.S.C. 154(b) by 0 days.

(21) Appl. No.: 09/766,786

(22) Filed: Jan. 22, 2001

(51) Int. Cl.[7] ..... A43B 13/28; A43B 13/18; A43B 23/00

(52) U.S. Cl. ..... 36/27; 36/28; 36/114; 36/137; 36/37

(58) Field of Search ..... 36/27, 28, 92, 36/114, 88, 144, 137, 37, 69, 76 R

(56) References Cited

U.S. PATENT DOCUMENTS

| | | | |
|---|---|---|---|
| 413,693 | A | 10/1889 | Walker |
| 507,490 | A | 10/1893 | Gambino |

(List continued on next page.)

FOREIGN PATENT DOCUMENTS

| | | | |
|---|---|---|---|
| EP | 335467 | * | 10/1989 |
| WO | 94/15494 | * | 7/1994 |

OTHER PUBLICATIONS

"Changing the Way the World Walks," Z. Tech Footwear, Europe; believed published circa 1999; published over the worldwide web at address: http://www.geocities.com/Pipeline/Slope/8676/.

"Z–Coil Shoes for Pain Relief," author unknown: web site believed published circa 1998; sections include "Our Company", "Shoe Anatomy", "Styles", "Products", and "History", published over the worldwide web at: http://www.zcoil.com/.

"Boing!" By Ron Lieber, Nov., 2000, published by Fast Company over the worldwide web at address: http://www/fastcompany.com/online/40/nike.html.

"Making Shoes that Bounce Back, Power UP," Popular Science, Nov. 2000; published by Times Mirror Magazine, New York, NY, pp. 57 and 58.

"Motor City Musings Nike Borrows from Formula One to Race on Sunday, Run on Monday," by John Clor, believed published circa Nov. 2000; published over the worldwide web at address: http://www.edmunds.com/edweb/editorial/McMusings/nike/.

"Nike to Shox the World," Press Release Authored by Nike Corp, Beaverton, OR., Nov. 15, 2000, Yahoo Finance, published on the worldwide web by Yahoo! at address: http://biz.yahoo.com/prnews/001115/or nike sh.html.

"Working Progress (bulletin board comment)", authored by David Nix, believed published circa Nov. 2000, published by Fast Company on the worldwide web at: http://www.fastcompany.com/soundoff/reader comment.html?cid=1734.

"Illuminated Sneakers, You Light Up My Sneakers," Charles L. Perrin, believed published circa Nov. 2000, published over the worldwide web at address: http://www/sneakers.pair.com/lightup.htm.

"Borges Invention Disclosure"; disclosure document believed un–published, and believed created circa Mar. 1999; documenting invention believed created circa Sep. 1998.

*Primary Examiner*—M. D. Patterson
(74) *Attorney, Agent, or Firm*—Greer, Burns & Crain, Ltd.

(57) ABSTRACT

A midsole comprises a heel cup having a semi-rigid upper plate, a lower plate composed of a material that is softer than the upper plate, and at least one telescopic shock absorber between the upper and lower plates. The telescopic shock absorbers have one portion that collapses into a second portion when the shock absorber is loaded or compressed. On release of the load, the shock absorbers of the invention return only a controlled portion of the compressive load originally applied. A second embodiment has a translucent heel cup and shock absorbers and a lamp for illuminating the heel cup and shock absorbers.

28 Claims, 5 Drawing Sheets

U.S. PATENT DOCUMENTS 968,020 A 8/1910 Yandoli
2,234,066 A 3/1941 Winkel et al.
2,387,334 A 10/1945 Lemke
2,399,543 A 4/1946 Dack
2,414,445 A 1/1947 Cahill
2,441,039 A 5/1948 Smith et al.
2,454,951 A 11/1948 Smith
2,669,038 A 2/1954 DeWerth
2,710,460 A 6/1955 Stasinos
2,985,971 A 5/1961 Murawski
2,998,661 A 9/1961 Israel
3,822,490 A 7/1974 Murawski
3,875,688 A 4/1975 McNaughton
3,886,674 A 6/1975 Pavia
3,996,677 A 12/1976 Reina
4,130,951 A 12/1978 Powell
4,183,156 A 1/1980 Rudy
4,187,620 A 2/1980 Selner
4,219,945 A 9/1980 Rudy
4,223,457 A 9/1980 Borgeas
4,237,625 A 12/1980 Cole et al.
4,262,433 A 4/1981 Hagg et al.
4,267,648 A 5/1981 Weisz
D260,196 S 8/1981 Plagenhoef
4,296,557 A 10/1981 Pajevic
4,302,891 A 12/1981 Gulli
4,314,413 A 2/1982 Dassler
4,322,892 A 4/1982 Inohara
4,322,893 A 4/1982 Halvorsen
4,342,158 A 8/1982 McMahon et al.
4,354,318 A 10/1982 Frederick et al.
4,360,978 A 11/1982 Simpkins
4,364,188 A 12/1982 Turner et al.
4,391,048 A 7/1983 Lutz
4,402,146 A * 9/1983 Parracho et al.
4,416,072 A 11/1983 Sarkissian
4,417,408 A 11/1983 Metro
4,457,084 A 7/1984 Horibata et al.
4,484,397 A * 11/1984 Curley, Jr.
4,490,928 A * 1/1985 Kawashima
4,492,046 A 1/1985 Kosova
4,506,460 A 3/1985 Rudy
4,521,979 A * 6/1985 Blaser ..... 36/28
4,534,124 A 8/1985 Schnell
4,535,553 A 8/1985 Derderian et al.
4,566,206 A 1/1986 Weber
4,573,279 A 3/1986 Feurer-Zogel et al.
4,592,153 A 6/1986 Jacinto
4,614,046 A 9/1986 Dassler
4,616,431 A 10/1986 Dassler
4,660,299 A 4/1987 Omilusik
4,670,996 A 6/1987 Dill
4,747,219 A 5/1988 Ammendolea
4,757,620 A 7/1988 Titola
4,766,681 A 8/1988 O'Rourke et al.
4,774,774 A 10/1988 Allen, Jr.
4,798,009 A 1/1989 Colonel et al.
4,817,304 A 4/1989 Parker et al.
4,817,305 A 4/1989 Wetzel
4,906,502 A 3/1990 Rudy
4,910,884 A 3/1990 Lindh et al.
4,918,838 A 4/1990 Chang
D307,608 S 5/1990 Shure
4,956,927 A 9/1990 Misevich et al.
4,989,350 A 2/1991 Bunch et al.
5,014,449 A 5/1991 Richard et al.
5,025,573 A 6/1991 Giese et al.
5,046,267 A 9/1991 Kilgore et al.
5,052,130 A 10/1991 Barry et al.
5,060,401 A 10/1991 Whatley
5,083,361 A 1/1992 Rudy
5,090,138 A 2/1992 Borden
5,125,171 A 6/1992 Stewart
5,197,206 A 3/1993 Shorten
5,197,207 A 3/1993 Shorten
5,201,125 A 4/1993 Shorten
5,235,761 A 8/1993 Chang
5,245,766 A 9/1993 Warren
5,247,742 A 9/1993 Kilgore et al.
D341,478 S 11/1993 Forland et al.
5,279,051 A 1/1994 Whatley
D344,174 S 2/1994 Kilgore
D344,398 S 2/1994 Kilgore
D344,399 S 2/1994 Kilgore
D344,400 S 2/1994 Kilgore
D344,401 S 2/1994 Kilgore
5,282,325 A 2/1994 Beyl
D344,622 S 3/1994 Kilgore
5,315,769 A 5/1994 Barry et al.
D350,018 S 8/1994 Kilgore
D350,019 S 8/1994 Kilgore
D350,020 S 8/1994 Kilgore
D350,225 S 9/1994 Kilgore
D350,226 S 9/1994 Kilgore
D350,227 S 9/1994 Kilgore
D350,433 S 9/1994 Kilgore
5,343,636 A 9/1994 Sabol
5,343,639 A 9/1994 Kilgore et al.
D351,057 S 10/1994 Kilgore
D351,720 S 10/1994 Kilgore
5,353,523 A 10/1994 Kilgore et al.
D351,936 S 11/1994 Kilgore
D352,159 S 11/1994 Kilgore
D352,160 S 11/1994 Kilgore
D354,617 S 1/1995 Kilgore
5,381,608 A 1/1995 Claveria
D355,755 S 2/1995 Kilgore
5,419,060 A 5/1995 Choi
5,419,061 A 5/1995 Barrocas
5,435,079 A 7/1995 Gallegos
5,461,800 A 10/1995 Luthi et al.
5,469,639 A 11/1995 Sessa
5,488,786 A 2/1996 Ratay
5,502,901 A * 4/1996 Brown
5,564,202 A 10/1996 Hoppenstein
5,572,804 A 11/1996 Skaja et al.
5,617,651 A 4/1997 Prahl
5,621,984 A 4/1997 Hsieh
5,649,373 A 7/1997 Winter et al.
5,678,327 A * 10/1997 Halberstadt ..... 36/27
5,682,690 A 11/1997 Chang
5,701,685 A 12/1997 Pezza
5,701,686 A 12/1997 Herr et al.
5,752,329 A 5/1998 Horibata
5,782,014 A 7/1998 Peterson
5,787,610 A 8/1998 Brooks
5,791,637 A 8/1998 Reichelt et al.
D397,543 S 9/1998 Silvers
5,845,419 A 12/1998 Begg
5,853,844 A 12/1998 Wen
5,894,686 A * 4/1999 Parker et al.
5,918,384 A 7/1999 Meschan
5,918,502 A 7/1999 Bishop
5,976,451 A 11/1999 Skaja et al.
6,006,449 A 12/1999 Orlowski et al.
6,029,962 A 2/2000 Shorten et al.
6,061,929 A 5/2000 Ritter
D429,877 S 8/2000 Lozano et al.
6,098,313 A 8/2000 Skaja
6,108,943 A 8/2000 Hudson et al.
6,115,943 A * 9/2000 Gyr ..... 36/28
D431,898 S 10/2000 Clegg et al.
D432,293 S 10/2000 Clegg et al.
D433,216 S 11/2000 Avar et al.
D434,548 S 12/2000 Gallegos

* cited by examiner

PRIOR ART METAL SPRINGS

PRIOR ART AIR SPRINGS

PRIOR ART ELASTOMERIC FOAM BUMPERS

MIDSOLE OF THE INVENTION

SHOCK ABSORBING MIDSOLE FOR AN ATHLETIC SHOE

FIELD OF THE INVENTION

The present invention relates generally to footwear midsoles, and more particularly to shock absorbing midsoles, including heel cups and shanks, for athletic footwear.

BACKGROUND OF THE INVENTION

Athletic footwear generally comprises a sole and an upper. The sole may be a single piece, but more commonly comprises multiple layers, namely, an outsole, insole and midsole there between. The outsole provides a tough, wear resistant layer and suitable tread for providing traction against the ground or floor. The insole is a thin, soft layer, and typically provides for comfort. The midsole is the primary structural layer in the sole, and provides for shock absorption.

Persons skilled in the art of athletic footwear design have endeavored to improve midsole shock absorption, especially shock caused by heel strike, while maintaining the structural integrity of the shoe and providing an adequate level of cushioning for comfort. Various solutions have been proposed and used. For example, U.S. Pat. No. 4,614,046 assigned to Puma Sportschufabriken Rudolf Dassler KG and U.S. Pat. No. 4,364,188 assigned to Wolverine World Wide, Inc. disclose running shoes having midsoles comprises of elastomeric foam. The midsoles have several zones or areas where elastomeric foam of different stiffness is used to balance the need for shock absorption and stability. Different types of elastomeric foams are disclosed, including ethylene-vinyl acetate ("EVA"), polyethylene, and polyurethane foams.

In an effort to improve on shock absorption, midsoles incorporating air bags have been developed. For example, U.S. Pat. No. 4,871,304 assigned to Nike, Inc., discloses a combination of a gas filled bladder within elastomeric foam materials. The combination of air bags with foam was intended to provide a mechanism for adjusting the impact response characteristics of the sole to desired requirements, such as the requirements for a particular sport. In a somewhat similar vein, U.S. Pat. No. 4,535,553, assigned to Nike, Inc. discloses an athletic shoe midsole that features a pattern of discrete, spaced, plastic shock absorbing projections in combination with elastomeric foam. Finally, U.S. Pat. No. 5,343,639 to Nike, Inc. discloses an athletic shoe midsole having plural columns disposed between upper and lower plates in the heel region of the shoe. The columns are elastomeric foam tubes, and include gas bladders disposed in hollow regions within the columns.

A drawback of most prior art midsoles is that they return a substantial portion of the energy of foot strike, which can be detrimental to the athlete. Specifically, most midsoles comprised of elastomeric foam and/or air bags, act as springs—storing the energy from foot strike while under compression, which may be returned immediately. This action may be referred to as energy return or rebound. There are those skilled in the art that hold the view that energy return is desirable. However, it has been found that rebound can produce undesirable shock to the athlete, and can in some cases lead to injury.

Another design objective of athletic footwear is stability. It is common among runners, particularly in amateur athletics, to land on their heels. More specifically, the foot strike occurs on the lateral side of the heel. As the athlete's body moves forward, weight is transferred progressively forward and towards the medial side of the foot. The foot leaves the ground ("toe off") with the runner's weight on the medial side of the foot. This rolling motion from lateral-heel to medial-toe is known a "pronation." It is common in some athlete's to detrimentally over pronate. To counteract over pronation, it is know to provide stabilizers in athletic shoe midsoles. For example, U.S. Pat. No. 4,614,046 to Puma Sportschufabriken Rudolf Dassler KG and U.S. Pat. No. 4,364,188 to Wolverine World Wide, Inc. disclose midsole designs where harder, less compressible materials are inserted or otherwise disposed on the medial sides of the heel midsole to control over pronation.

Structural integrity, torsional stability and ach support are yet other design considerations in footwear, including athletic footwear. U.S. Pat. No. 6,061,929 to Deckers Outdoor Corporation discloses a midsole with an integrally molded shank for providing torsional rigidity and arch support. It is also known to be beneficial to provide a heel cup, to surround and protect the athlete's heel.

Although the foregoing efforts have met with varying degrees of success, there remains an unresolved need for a midsole for athletic footwear with improved shock absorption, stability and structural integrity.

OBJECTS OF THE INVENTION

It is an object of the invention to provide footwear midsole that has improved shock-absorbing performance in the heel region of the footwear. More specifically, it is an object to provide superior shock absorption, while minimizing undesirable rebound.

It is a second object of the invention to provide footwear having improved stability, especially torsional rigidity and over pronation control.

It is a third object of the invention to provide an innovative and attractive athletic shoe.

SUMMARY OF THE INVENTION

The foregoing objects are met by the midsole of the invention. The midsole comprises a heel cup having a semi-rigid upper plate, a lower plate composed of a material that is softer than the upper plate, and a plurality of telescopic shock absorbers between the upper and lower plates.

The midsole preferably comprises four spaced apart shock absorbers in the heel portion of the midsole. The telescopic shock absorbers have one portion that collapses into a second portion when the shock absorber is loaded or compressed. The shock absorbers are constructed to absorb significant compressive loads from heel strike during athletic use. On release of the load, however, the shock absorbers of the invention return only a controlled portion of the compressive load originally applied. More specifically, the shock absorbers have the capacity to absorb a predetermined maximum load, which is based on a variety of factors including the particular sport and the anticipated weight of the athlete. On release of the compressive load, a predetermined portion of the original load will be returned. Generally, the force returned will be a minor fraction of the original compressive load. Accordingly, energy resulting from heel strike is absorbed and dissipated and is not returned to the athlete's body. The shock absorbers of the invention operate in a manner that is analogous to hydraulic dampening, as contrasted with springs that return applied compressive forces.

Desirably, the shock absorbers of the invention have plural stages, namely a relatively soft, easily compressible first stage, and at least one stiffer second stage to absorb higher compressive forces. More specifically, the first stage has a compression value that is predetermined to provide noticeable cushioning for low activity levels, such as walking. The second stage has a significantly higher compression value predetermined to absorb maximum loads from high activity levels, such as running or jumping. Additional or intermediate stages could be provided. There may be a multiplicity of incremental stages. As a result, the shock absorbers of the invention provide cushioned comfort at light activity levels, e.g., walking, while providing superior shock absorption at higher activity levels, e.g., running.

The stiffness of the shock absorbers may be adjusted as desired. Preferably the rear most shock absorbers are stiffer than the forward ones. In some applications, it may be desirable that the rear lateral shock absorber is stiffer than the medial shock to absorb anticipated heel strike on the lateral side. Further, the stiffness of the shock absorbers may be adjusted based on the anticipated compressive forces. By way of example, small shoe sizes should have relatively softer shock absorbers than large sizes. Midsoles for men's footwear should have stiffer shocks than women's. Midsoles designed for running applications should be softer than midsoles for basketball.

The midsole of the invention further comprises a semi-rigid, integral heel cup and shank member. The heel cup includes a semi-rigid upper plate. The member provides torsional rigidity and structural integrity to the midsole. A transverse opening or slot is provided between the heel cup and shank portions. The shank has a longitudinal, upwardly projecting arch that separates and bridges between the heel and forefoot portions of the sole. Thus, the shank supports the user's arch and provides an improved appearance to the footwear.

The lower plate has a forward edge that projects through the transverse opening in the heel cup and shank member. The forward edge is attached to a top, inside surface of the shank. A forefoot midsole comprised of conventional ethylene-vinyl acetate ("EVA") foam is provided. A rear portion of the EVA foam extends over the shank and fills and seals the opening in the upper member.

The lower plate is desirably composed of a material that is softer and more flexible than the upper plate. As a result, the top portions of the shock absorbers are fixed relative to one another, while the lower portion of the shock absorbers have some freedom of movement relative to one another. Thereby, the bottom surface of the footwear may flex to engage the contours of the ground while allowing the heel cup and foot of the wearer to remain relatively stable. The comparatively soft lower plate, anchored to the shank, allows the shock absorbers a smooth and full range of motion.

The shock absorbers are fasten to the upper and lower plates with adhesive and mechanical connection. The upper plate has a plurality of recesses, each recess for receiving and mounting a top surface of a respective one of the shock absorbers. A bottom edge of each shock absorber has a flange. The bottom plate has a plurality of brackets for receiving each shock flange to thereby mount the shock absorbers to the bottom plate.

A vertical heel stiffener is provided that is unitary with the lower plate and connected to the heel cup. The heel stiffener is disposed on the medial side of the heel, and as a result provides over pronation control.

The heel portion of the midsole of the invention is desirably open so as to expose the shock absorbers to view. The absence of sidewalls reduces weight. Further, exposure of the shock absorbers provides a visually enhanced look to the footwear. To further enhance the visual effect, the midsole of the invention may optionally comprise a light source attached to the heel midsole for illuminating the shock absorbers. The heel cup is preferably translucent and the light source comprises sheet material in the heel cup. Thereby the light source illuminates the heel cup and shock absorbers creating a desirable visual effect.

Accordingly, the objects of the invention have been achieved. Further features and advantages of the invention will become apparent from the detailed description of the preferred embodiment of the invention that follows.

DETAILED DESCRIPTION OF THE PREFERRED EMBODIMENTS

Figure 1:
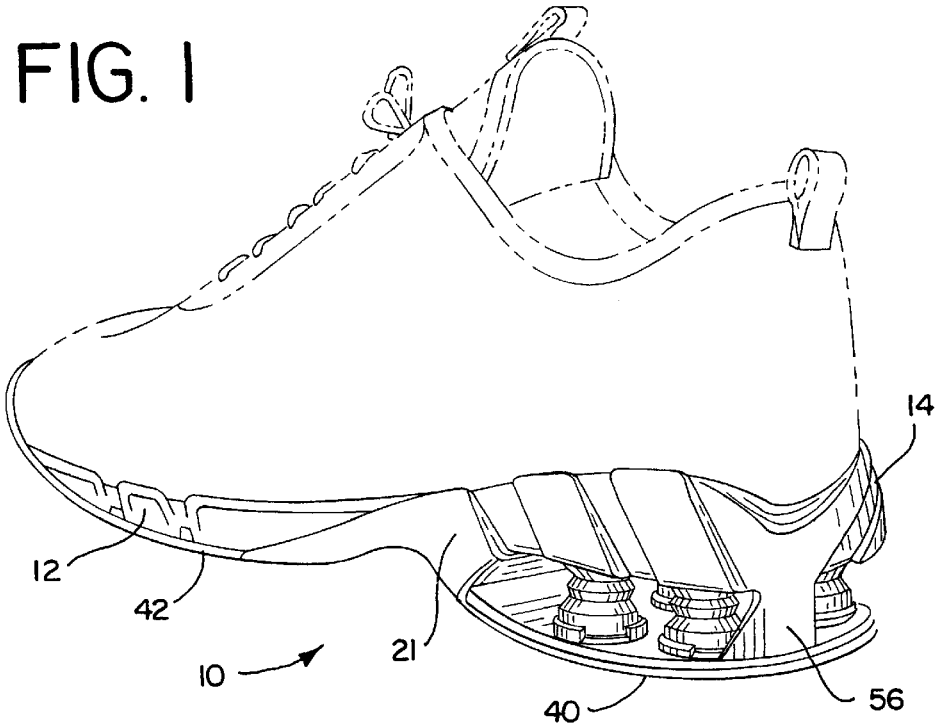
FIG. 1 is a perspective view of a preferred embodiment of the midsole of the invention. An upper is shown in dashed lines for location and environment purposes and does not form a part of the invention.
Figure 2:
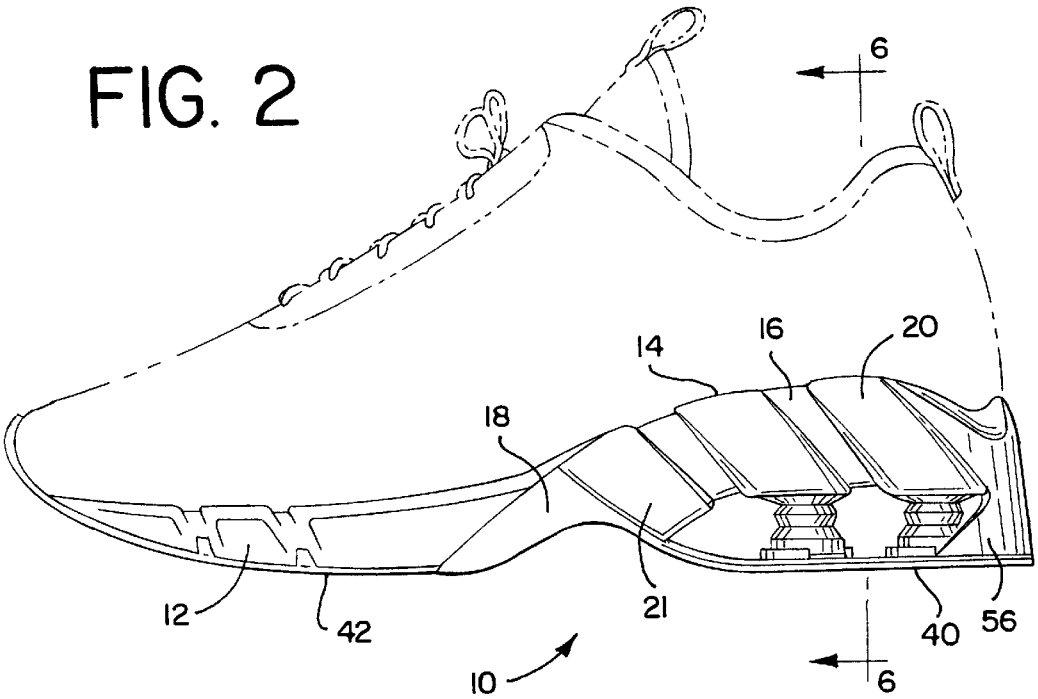
FIG. 2 is a medial side, elevational view of the preferred embodiment.
Figure 3:
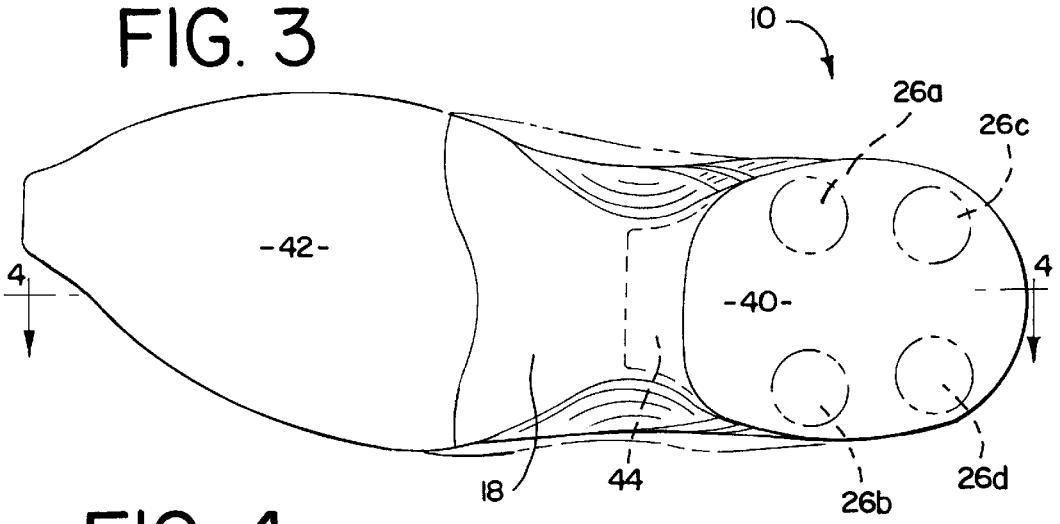
FIG. 3 bottom plan view of the preferred embodiment.

The following is a detailed description of preferred embodiments of the invention, which are presently deemed by the inventor to be the best mode of carrying out the invention. It is to be understood that the drawings and specifications are conceptual and are intended to convey knowledge in a concise manner so as to enable persons skilled in the art to make and use the invention. Additional embodiments and variations thereof will be apparent to those skilled in the art. Illustration and disclosure of the preferred embodiments shall not be construed as limitations on the invention, which is defined by the appended claims.

Turning now to the drawings, FIGS. 1–6 illustrate a first preferred embodiment of the invention. The midsole comprises forefoot portion 12 and a rear foot portion 14. The rear foot includes a semi-rigid, unitary upper member 16, having shank portion 18 and a heel cup 20. The heel cup 20 includes a semi-rigid upper plate 22. The midsole further comprises a lower plate 24 and four shock absorbers 26 between the upper and lower plates. Although four shock absorbers are shown and described, the invention could be practiced with one or more shocks.

The shock absorbers 26 are telescopic, that is, the shock collapses on itself. The shock absorber 26 shown in FIG. 4 has two distinct stages. An upper, softer portion 28 of the shock collapses into itself A distinct, lower, stiffer portion 30 also collapses on itself when the shock absorber is loaded or compressed. The shock absorbers 26 of the invention are self centering, as each stage collapses into itself, which provides stability to the midsole of the invention.

The shock absorbers are constructed to absorb significant compressive loads from heel strike during athletic use. On release of the load, however, the shock absorbers of the invention return only a fraction of the compressive load originally applied. The maximum load capacity for the shock absorbers will vary depending on several factors, including the particular sport, and the anticipated weight of the athlete or other user. The amount of energy return may also be predetermined and controlled by shock absorber design. Accordingly, most of the energy resulting from heel strike is absorbed and dissipated, and only a predetermined, non-detrimental fraction of the original load is returned to the athlete's body. The shocks operate in a manner that is analogous to hydraulic dampening, as contrasted with springs that return applied compressive forces.

Figure 9:
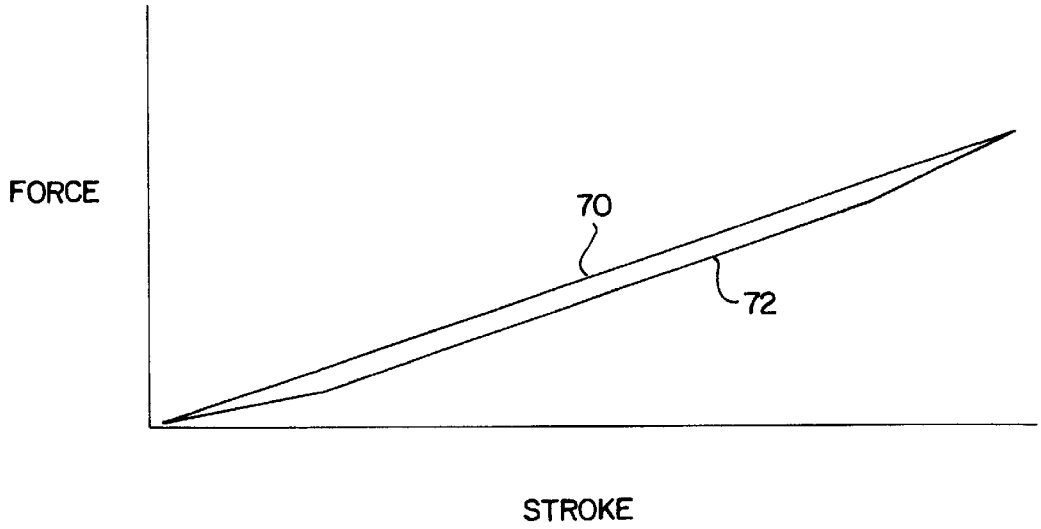
FIG. 9 is a theoretical graph of force as a function of stroke for prior art metal springs.
Figure 10:
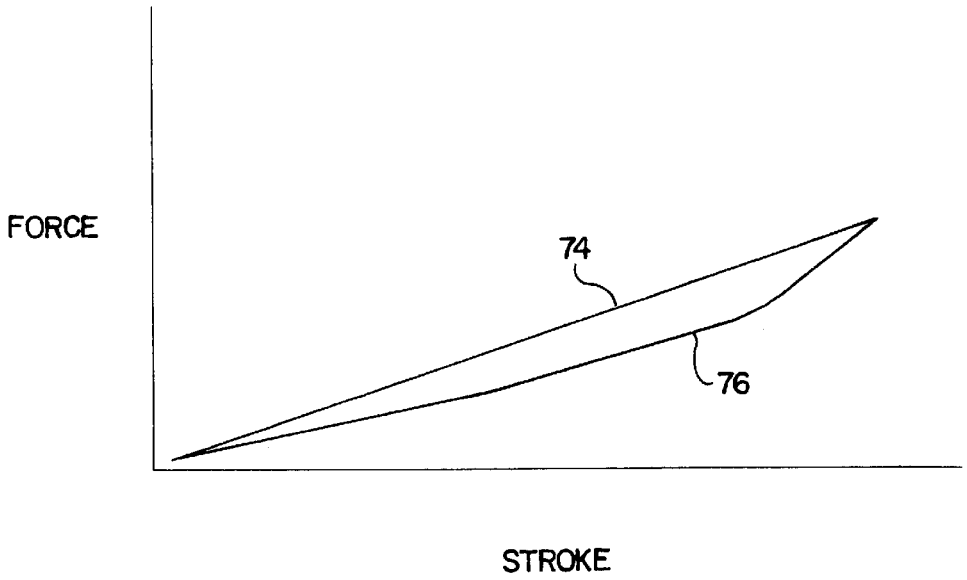
FIG. 10 is a theoretical graph of force as a function of stroke for prior art air springs.

Graphs, FIGS. 9–12 compare the theoretical performance of a prior art metal springs, prior art air springs, prior art elastomeric foam bumpers with the of the invention. Line 70 of FIG. 9 shows a linearly increasing force with stroke as the prior art spring is compressed. Initial the resistance to compression is low, but as the spring is compressed resistance increases. Line 72 shows the return line as load is removed. For a given stroke value the force on return line 72 is slightly less but close to the original compression line 70. Most of the force applied is returned. A similar reaction is apparent with prior art air springs, FIG. 10. In FIG. 10, return line 76 is spaced somewhat from compression line 74 indicating a level of energy absorption that is not returned.

Figure 11:
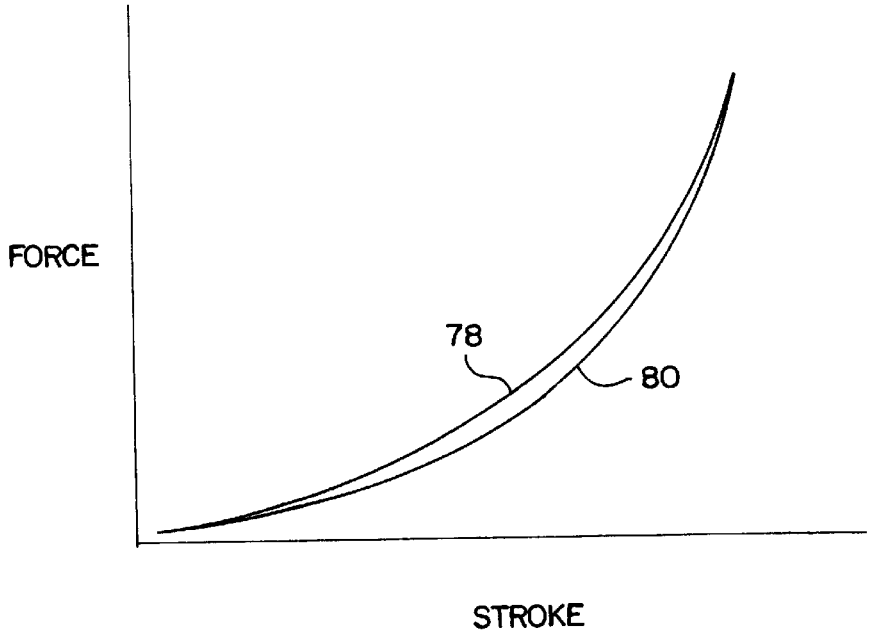
FIG. 11 is a theoretical graph of force as a function of stroke for prior art elastomeric foam bumpers.

FIG. 11 shows the theoretical compression curves for elastomeric foam materials. Here, the compression line 78 is not linear. The force for a given increment of stroke is low initially and rapidly increases as the bumper is compressed. As load is removed, energy return line 80 closely matches the initial compression line. For a given stroke, the energy return is close to the initial compression resistance force.

Figure 12:
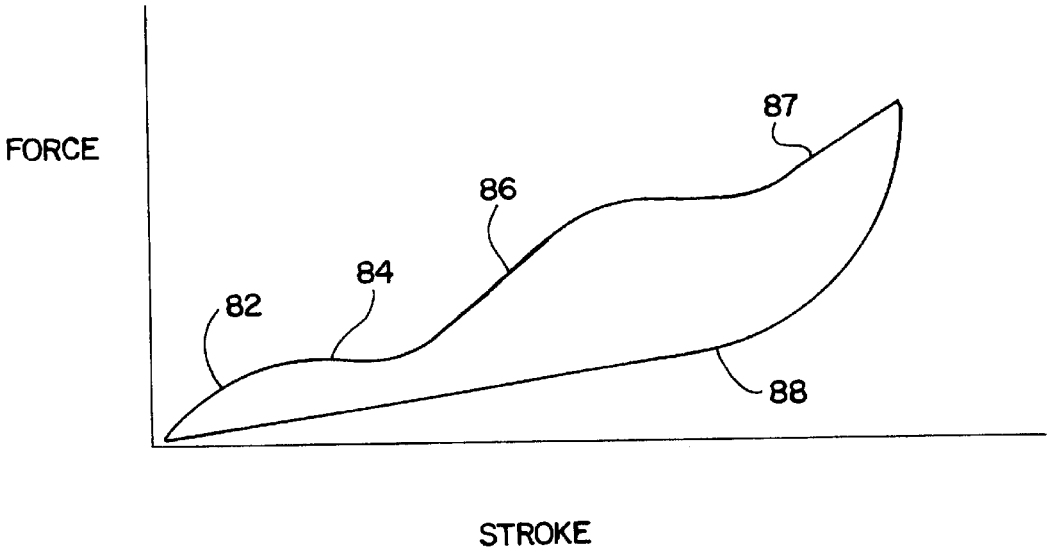
FIG. 12 is a theoretical graph of force as a function of stroke for the midsole of the invention.

FIG. 12 show theoretical compression curves for the midsole of the invention. Line 82 shows a comparatively low resisting force as the first stage of the shock absorbers are compressed. At 84 there is a transition as the first stage bottoms out and the second stage of the shock absorbers is engaged. Curve 86 shows that the comparatively high resistive force of the second stage. Curve 87 shows maximum compressive resistance. Line 88 shows the return force. Unlike the prior art, the midsole of the invention returns a comparatively small amount of force. Prior art midsoles general acts as a spring—storing foot strike energy while under compression, and in some cases immediately returning a substantial portion of that energy. As indicated above, there are those skilled in the art that hold the view that energy return is desirable. However, it has been found that rebound produces undesirable effects in athletic footwear, and in some cases, can lead to injury. In contrast, line 88 of FIG. 12 show the performance of the midsole of the invention. It is seen that the midsole absorbs heel strike, while greatly reducing rebound or energy return.

Desirably, the shock absorbers of the invention have plural stages, namely a relatively soft, easily compressible first stage, and at least one stiffer second stage to absorb higher compressive forces. As can be seen from FIG. 12, there are two discrete force vs. stroke functions for the midsole of the invention. Additional or intermediate stages can be provided. Indeed, one may engineer multiplicity of incremental stages.

The stiffness of the shock absorbers may be adjusted as desired. In most cases, the first stage of all of the shock absorbers will have the same level of stiffness. The second stage of each shock absorber may be designed to absorb different loads. Preferably the rear most shock absorbers 26*c*, 26*d* are stiffer than the forward ones 26*a*, 26*b* (see FIG. 3). Also, it is desirable that the rear lateral shock absorber 26*d* is stiffer than the rear medial shock 26c. The stiffness of the second stage may also be adjusted based on the anticipated compressive forces. By way of example, small shoe sizes should have relatively softer shock absorbers than large sizes. Midsoles for men's footwear should have stiffer shocks than women's. Midsoles designed for running applications should be softer than midsoles for basketball.

Shock absorbers 26 of the invention may be obtained from Iso Dyamics, Inc., 19577 Progress Drive, Strongsville, Ohio. U.S. Pat. No. 5,791,637, which is hereby incorporated by reference, discloses the design and method of making shock absorbers suitable for the invention, albeit single stage shock absorbers. The shock absorbers 26 are preferably fabricated from Hytrel® thermoplastic polyester elastomer, produced by E.I. du Pont de Nemours and Company; or Pebax® thermoplastic elastomer, produced by Atofina Chemicals, Inc., 2000 Market Street, Philadelphia, Pa. 19103. The Hytrel elastomer has superior durability. Pebax elastomer is lighter weight than Hytrel, has superior bonding ability, and is desirably translucent. The preferred hardness of the elastomer is about 55 durometer. Other elastomeric resins may be suitable as well, and the present invention should not be considered limited to the preferred elastomers.

The semi-rigid, integral heel cup and shank member 16 is injection molded from thermal polyurethane ("TPU") thermoplastic have a hardness of at least 60 Shore D hardness, and may have be as high as 71 Shore D. The heel cup has lateral, medial sides 21 and a backside 23. The heel cup includes an upper plate 22 that has a web thickness of about 2 mm. The member 16 has a transverse opening or slot 36 between the heel cup 20 and shank 18. The shank 18 has a longitudinal, upwardly projecting arch 38 that separates and bridges between a heel outsole 40 and forefoot outsole 42.

The lower plate 24 has a forward edge 44 that projects through the transverse opening 36 in upper member 16. The forward edge is attached to a top surface 46 of the shank 18. The forefoot midsole 12 is molded of conventional foam. A rear portion 47 of the ethylene-vinyl acetate forefoot midsole extends over the shank 18 and fills and seals the opening 36 in the upper member 16. Although EVA foam is preferred for the forefoot midsole, other elastomeric foams and composite materials may be used.

The lower plate 24 is preferably molded of TPU thermoplastic having a durometer hardness of between about 45 to 55 Shore D hardness, and a web thickness of about 1.5 mm. As such, the lower plate is softer and more flexible than the upper plate. As a result, the top portions of the shock absorbers 28 are fixed relative to one another, while the lower portion of the shock absorbers 30 have some freedom of movement relative to one another. Thereby, the bottom surface of the footwear may flex to engage the contours of the ground while allowing the heel cup and foot of the wearer to remain stable. As each shock absorber has independent movement, the shocks may react with quicker response time than they would if bound together.

Figure 4:
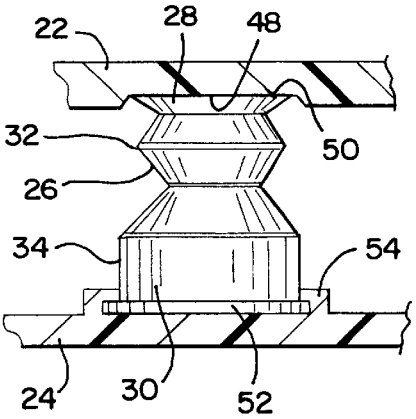
FIG. 4 is a detail of a shock absorber of the invention mounted between the upper and lower plates.
Figure 5:
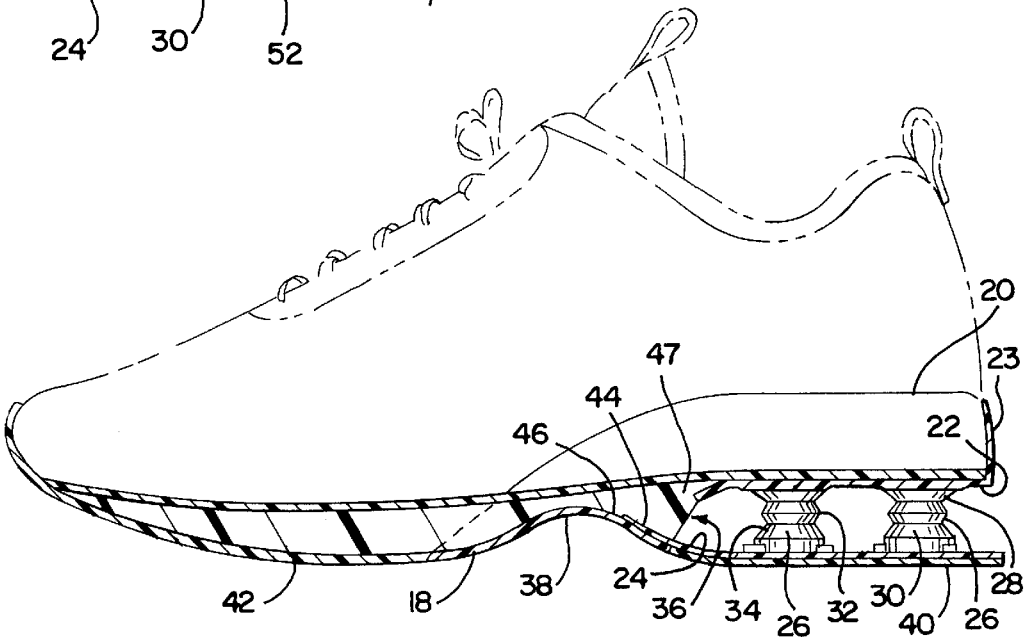
FIG. 5 is a longitudinal cross-section taken along line 4—4 of FIG. 3.
Figure 6:
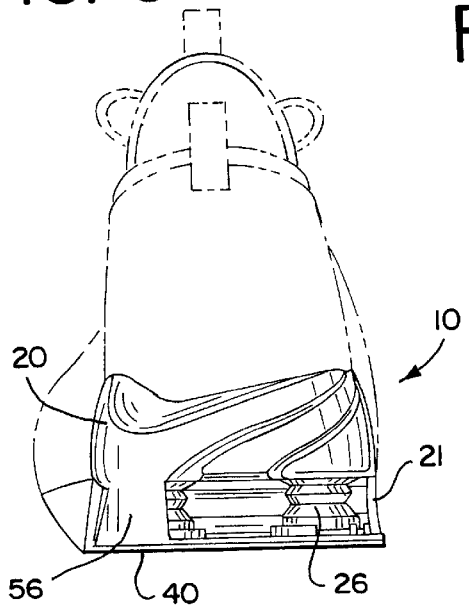
FIG. 6 is rear elevational view of the preferred embodiment.
Figure 7:
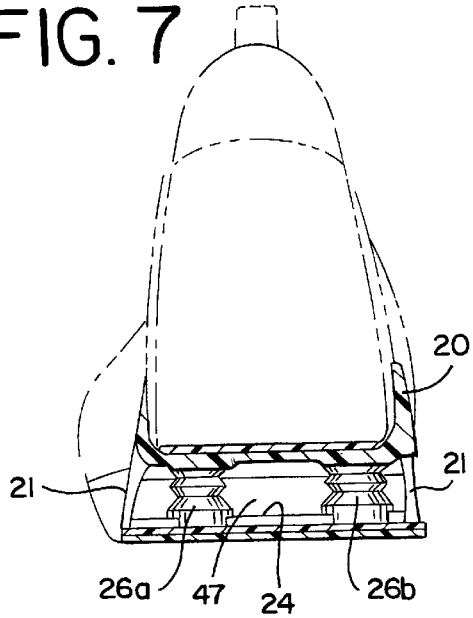
FIG. 7 is a cross-sectional view taken along line 6—6 of FIG. 2.

The shock absorbers 26 are fastened to the upper 22 and lower 24 plates with adhesive. As shown in FIG. 4, an improved mechanical connection is preferably made. Specifically, the upper plate has a plurality of recesses 48, each recess for receiving and mounting a top surface 50 of a respective one of the shock absorbers 26. A bottom edge of each shock absorber has a flange 52. The bottom plate 24 has a plurality of brackets 54 for receiving each shock flange to thereby mount the shock absorbers to the bottom plate.

A vertical heel stiffener 56 is provided that is unitary with lower plate 24 and connected to the heel cup 20 with adhesive. The heel stiffener is the medial side of the heel, and as a result provides over pronation control.

Figure 8:
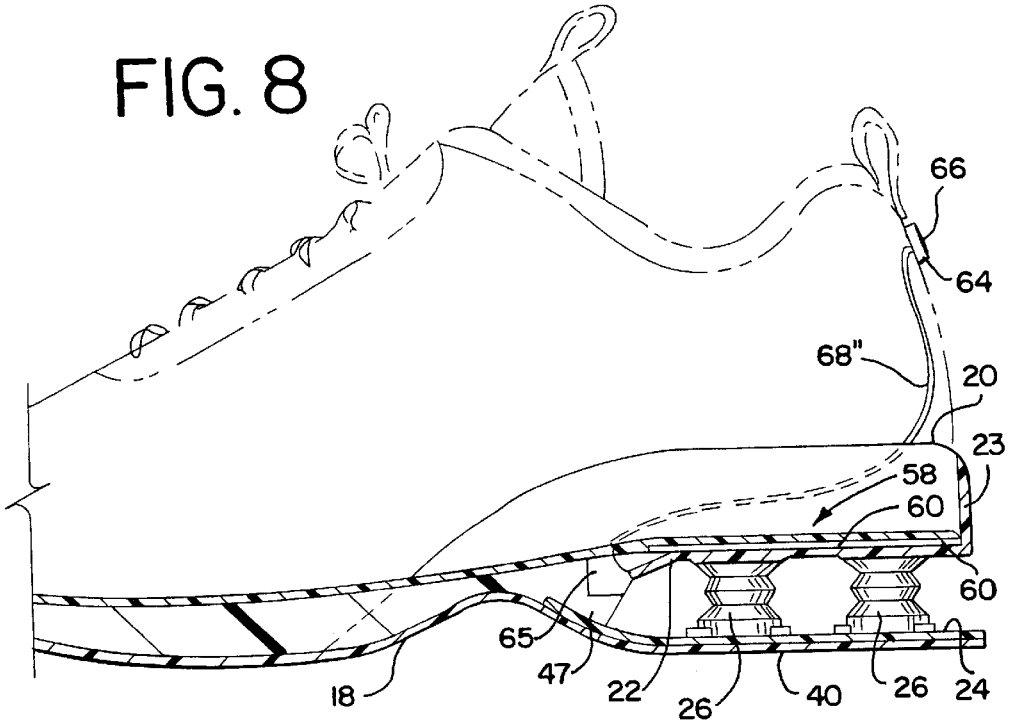
FIG. 8 is a partial longitudinal cross-sectional view of a second embodiment of the invention similar in view to FIG. 5.

FIG. 8 illustrates a second embodiment of the invention. The description and reference numerals applicable to the first embodiment apply equally to the second embodiment. The second embodiment is characterized by a light source 58 attached to the heel midsole for illuminating said heel cup 20 and shock absorbers 26. The light source comprises a sheet material lamp 60 mounted in the heel cup 20. The heel cup is made of translucent TPU so that light generated by lamp 60 is conveyed though the entire heel cup 20 and shank 18 member and also highlights the shock absorbers 26 of the invention. The sheet material lamp is commercial available, such as a micro-encapsulation phosphor technology from Durel Corporation, 2225 W. Chandler Blvd., Chandler, Ariz. 85224. A conventional battery 64 powers the lamp. An inverter 65 may also be required depending on the nature of the lamp technology. A switch 66 is provided to energize/de-energize the lamp 60. Wires 68 connect the battery 64, switch 66, inverter 65 and lamp 60. Preferably, the inverter 65 is housed in the midsole. The switch 66 and battery 64 may be housed together in the upper, such at the heel as shown, but may be located elsewhere. The battery should be in an accessible location.

While the preferred embodiments of the present invention have been shown and described, it is to be understood that these are merely the best mode for practicing the invention that the inventors foresee at the present time, and that various modifications and changes could be made thereto without departing from the scope and spirit of the invention as defined in the appended claims.

What is claimed is:

1. A midsole for footwear comprising, a semi-rigid upper plate;

a lower plate, said lower plate composed of a material that is softer than said upper plate; and at least one shock absorber between said upper plate and said lower plate, said shock absorber being telescopic whereby compression causes one portion of said shock absorber to retract within a second portion of said shock absorber, said shock absorber comprising means for returning a force in response to an applied load, said return force being a minor portion of said applied load.

2. A midsole as in claim 1, further comprising a semi-rigid heel cup, said upper plate comprising an integral portion of said heel cup.

3. A midsole as in claim 2, further comprising a semi-rigid shank portion, said shank portion being unitary with said heel cup.

4. A midsole as in claim 3 wherein said shank is longitudinally arched.

5. A midsole as in claim 4, wherein said unitary heel cup and shank includes a transverse slot between said heel cup and said shank for receiving a forward edge of said lower plate, said forward edge extending through said transverse opening and being attached to a top surface of said shank.

6. A midsole as in claim 5, further comprising a forefoot midsole member, a rear portion of said forefoot midsole member extending over said shank and filling said transverse slot.

7. A midsole as in claim 1, wherein said upper plate has a hardness of at least about 60 Shore D hardness, and said lower plate has a hardness of between about 45 and 55 Shore D hardness.

8. A midsole as in claim 1 further comprising means for controlling over pronation between said upper and lower plates.

9. A midsole as in claim 1, further comprising a heel stiffener on the medial heel edge of the midsole, connecting said upper plate and said lower plate.

10. A midsole as in claim 1, wherein there are four said shock absorbers between said upper and lower plates.

11. A midsole as in claim 10, wherein there are a forward pair of said shock absorbers and a rear pair, said rear pair being stiffer than said forward pair.

12. A midsole as in claim 1, wherein said at least one shock absorber returns substantially less energy than that applied to compress said shock absorbers.

13. A midsole as in claim 1, wherein said shock absorbers have two compression stages, the second stage being stiffer than the first stage.

14. A midsole as in claim 13, wherein said first stage provides cushioning for predetermined low level of activity, and said second stage is stiffer to provide cushioning at a predetermined high level of activity.

15. A midsole as in claim 1, wherein said upper plate has at least one recess for receiving and mounting a top surface of a said shock absorber; a bottom edge of said shock absorber having a flange; and said bottom plate having at least one bracket for receiving each said flange and thereby mounting said shock absorber to said bottom plate.

16. A midsole as in claim 1, further comprising a light source attached to the heel midsole for illuminating said shock absorbers.

17. A midsole as in claim 16, further comprising a translucent heel cup, wherein said light source comprises sheet material mounted to said heel cup.

18. A midsole as in claim 16, wherein at least one of said shock absorbers comprises a translucent material.

19. A midsole as in claim 1, further comprising a unitary heel cup and shank, said upper plate comprising a portion of said heel cup, a forward edge of said lower plate being anchored to said shank, and wherein there are plurality of said telescopic shock absorbers between said lower and upper plates.

20. A midsole as in claim 1, wherein a heel portion of said midsole is open and said shock absorbers are exposed to view.

21. A midsole for footwear comprising, a semi-rigid upper plate;

a lower plate composed of a material that is softer than said upper plate; and a plurality of shock absorbers between said upper plate and said lower plate, said shock absorbers having two compression stages, a first stage having a predetermined compression value, and a second stage having a predetermined compression value higher than said first stage compression value.

22. A midsole for footwear comprising, a semi-rigid upper plate;

a lower plate, said lower plate being softer than said upper plate; and a plurality of telescopic shock absorbers between said upper plate and said lower plate, whereby compression causes one portion of said shock absorbers to retract within a second portion of said shock absorbers, said shock absorbers having two compression stages, a first stage having a predetermined soft compression value, and a second stage having a predetermined stiff compression value; each of said shock absorbers having the capacity to absorb a load, and on release of such load returning a predetermined portion of the original load.

23. A midsole for footwear comprising, a translucent heel cup, said heel cup having a semi-rigid upper plate;

a lower plate;

a plurality of shock absorbers between said upper plate and said lower plate, at least one of said shock absorbers being translucent; and a light source mounted to said heel cup to illuminate said heel cup and said shock absorbers.

24. A midsole for footwear comprising, a semi-rigid, integral heel cup and shank member, said member having a transverse opening between said heel cup and said shank, said shank having a longitudinal, upwardly projecting arch, said heel cup having a semi-rigid upper plate;

a lower plate, a forward edge of said lower plate extending through said transverse opening in said heel cup and shank member, said forward edge attached to a top surface of said shank, said lower plate composed of a material that is more flexible than said upper plate;

a heel stiffener unitary with said lower plate and connected to said upper plate, said heel stiffener on the medial side of the heel; and a plurality of telescoping shock absorbers between said upper plate and said lower plate.

25. A midsole for footwear comprising, a semi-rigid, integral heel cup and shank member, said member having a transverse opening between said heel cup and said shank, said shank having a longitudinal, upwardly projecting arch, said heel cup having a semi-rigid upper plate;

a lower plate, a forward edge of said lower plate extending through said transverse opening in said heel cup and shank member, said forward edge attached to a top surface of said shank, said lower plate composed of a material that is more flexible than said upper plate;

a heel stiffener unitary with said lower plate and connected to said upper plate, said heel stiffener on the medial side of the heel; and a plurality of telescopic shock absorbers between said upper plate and said lower plate, whereby compression causes one portion of said shock absorbers to retract within a second portion of said shock absorbers, said shock absorbers having two compression stages, a first stage having a predetermined soft compression and said second stage being stiffer than said first stage, each of said shock absorbers having the capacity to absorb a load, and on release of such load returning only a fractional predetermined portion of said load.

26. A midsole for footwear comprising, a heel cup, a portion of said heel cup comprising a semi-rigid upper plate;

a lower plate, said lower plate composed of a material that is softer than said upper plate;

a shank portion, said shank portion being longitudinally arched and unitary with said heel cup and including a transverse slot between said heel cup and said shank for receiving a forward edge of said lower plate, said forward edge extending through said transverse slot and being attached to a top surface of said shank; and at least one shock absorber between said upper plate and said lower plate, said shock absorber being telescopic whereby compression causes one portion of said shock absorber to retract within a second portion of said shock absorber.

27. A midsole as in claim 26, further comprising a forefoot midsole member, a rear portion of said forefoot midsole member extending over said shank and filling said transverse slot.

28. A midsole for footwear comprising, a semi-rigid upper plate;

a lower plate, said lower plate composed of a material that is softer than said upper plate;

a plurality of shock absorbers between said upper plate and said lower plate, said shock absorbers being telescopic whereby compression causes one portion of each of said shock absorbers to retract within a second portion of each of said shock absorbers; and a unitary heel cup and shank, said upper plate comprising a portion of said heel cup, a forward edge of said lower plate being anchored to said shank.

* * * * *